US009039116B2

(12) United States Patent
Otokita

(10) Patent No.: US 9,039,116 B2
(45) Date of Patent: May 26, 2015

(54) LIQUID EJECTING APPARATUS

(71) Applicant: Seiko Epson Corporation, Shinjuku-ku, Tokyo (JP)

(72) Inventor: Kenji Otokita, Yamagata-mura (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/072,006

(22) Filed: Nov. 5, 2013

(65) Prior Publication Data

US 2014/0125722 A1 May 8, 2014

(30) Foreign Application Priority Data

Nov. 7, 2012 (JP) ..... 2012-245100

(51) Int. Cl.
*B41J 29/38* (2006.01)
*B41J 2/045* (2006.01)

(52) U.S. Cl.
CPC ..... *B41J 2/0451* (2013.01); *B41J 2/04581* (2013.01); *B41J 2/04595* (2013.01); *B41J 2/04596* (2013.01)

(58) Field of Classification Search
USPC ..... 347/5, 9, 10, 11, 19, 12
See application file for complete search history.

(56) References Cited

U.S. PATENT DOCUMENTS 6,099,103 A * 8/2000 Takahashi ..... 347/11
7,328,962 B2 2/2008 Higuchi et al.
2002/0089562 A1* 7/2002 Simons et al. ..... 347/19

FOREIGN PATENT DOCUMENTS

JP 2005-335294 A 12/2005
JP 2006-116705 A 5/2006
JP 2006-312329 A 11/2006

* cited by examiner

*Primary Examiner* — Lam Nguyen
(74) *Attorney, Agent, or Firm* — Kilpatrick Townsend & Stockton LLP

(57) ABSTRACT

A liquid ejecting apparatus includes a piezoelectric element, a nozzle that ejects a liquid in association with the driving of the piezoelectric element, a driving signal generation unit that generates a driving signal for driving a plurality of the piezoelectric elements, and a residual vibration detection unit that detects residual vibration generated by the driving of the piezoelectric element. The driving signal includes an ejection pulse for ejecting a liquid, a first vibration damping pulse that suppresses residual vibration generated by the ejection pulse, a second vibration damping pulse which is a pulse different from the first vibration damping pulse and suppresses residual vibration generated by the ejection pulse, and an inspection pulse for detecting the residual vibration signal.

8 Claims, 6 Drawing Sheets

| LAT1 | | | | | | LAT2 | | |
|---|---|---|---|---|---|---|---|---|
| SP | | 1 | 2 | 3 | 4 | SP | | 1 |
| 00 | NOT EJECTED | × | × | × | × | 00 | NOT DETECTED | × |
| 01 | SMALL | × | ○ | × | × | 01 | DETECTED | ○ |
| 10 | MIDDLE | ○ | × | ○ | × | 10 | – | × |
| 11 | LARGE | ○ | ○ | ○ | ○ | 11 | – | × |

| LAT1 | | | | | | LAT2 | | |
|---|---|---|---|---|---|---|---|---|
| SP | | 1 | 2 | 3 | 4 | SP | | 1 |
| 00 | NOT EJECTED | × | × | × | × | 00 | NOT DETECTED | × |
| 01 | SMALL | × | ○ | × | × | 01 | DETECTED | ○ |
| 10 | MIDDLE | ○ | × | ○ | × | 10 | – | × |
| 11 | LARGE | ○ | ○ | ○ | ○ | 11 | – | × |

LIQUID EJECTING APPARATUS

BACKGROUND

1. Technical Field

The present invention relates to a liquid ejecting apparatus such as an ink jet type recording apparatus, and more particularly, to a liquid ejecting apparatus that generates a fluctuation in pressure of liquid within a pressure chamber by deforming an operation unit constituting a portion of the pressure chamber, which communicates with a nozzle, to thereby eject the liquid from the nozzle, and a method of controlling the liquid ejecting apparatus.

Liquid ejecting apparatuses are apparatuses that include a liquid ejecting head capable of ejecting liquid as droplets from a nozzle and eject various types of liquids from the liquid ejecting head. A typical example of such a liquid ejecting apparatus can include an image recording apparatus such as an ink jet type recording apparatus (printer) which includes an ink jet type recording head (hereinafter, referred to as a recording head) and performs recording by ejecting ink in a liquid state as ink drops from a nozzle of the recording head. Besides, liquid ejecting apparatuses are used to eject various types of liquids such as a coloring material that is used in a color filter of a liquid crystal display or the like, an organic material that is used in an organic electroluminescence (EL) display, or an electrode material that is used to form an electrode. In addition, recording heads for an image recording apparatus eject ink in a liquid state, and coloring material ejecting heads for a display manufacturing apparatus eject a solution of each of red (R), green (G), and blue (B) coloring materials. In addition, electrode material ejecting heads for an electrode forming apparatus eject an electrode material in a liquid state, and biological organic material ejecting heads for a chip manufacturing apparatus eject a solution of a biological organic material.

For example, in the above-mentioned printer, when ink is not ejected from a nozzle due to factors such as clogging due to thickening of ink, that is, when so-called dot omission occurs, there is a concern that the quality of an image recorded in a recording medium may be decreased. Therefore, a technique of inspecting whether ink is reliably ejected from all nozzles has been proposed. For example, JP-A-2006-312329 discloses a technique of inspecting ejection abnormality of ink on the basis of a vibration pattern of liquid vibration (hereinafter, referred to as residual vibration) when an actuator (pressure generation unit) is driven.

Incidentally, in the recording head that is mounted to the above-mentioned printer, when the above-mentioned ejection abnormality is inspected in the middle of an operation (recording operation) of printing an image or the like on a recording medium such as a recording paper, there are problems in that a counter electromotive force is generated in an actuator due to damping vibration (residual vibration) of pressure vibration that is generated in ink within a pressure chamber at the time of the ejection of ink and that a current based on the counter electromotive force flows into an inspection circuit (leak current). That is, the leak current flows into the inspection circuit not only from an actuator corresponding to a nozzle to be inspected but also from an actuator of another nozzle belonging to the same nozzle array, and thus the current flowing thereinto is superimposed as noise on a detection signal. As a result, there is a problem in that the detection accuracy of ejection abnormality is decreased.

Meanwhile, such a problem exists not only in an ink jet type recording apparatus having a recording head, which ejects ink, mounted thereto but also in other liquid ejecting apparatuses that are configured to detect ejection abnormality on the basis of residual vibration generated by driving a pressure generation unit.

SUMMARY

An advantage of some aspects of the invention is to provide a liquid ejecting apparatus capable of improving detection accuracy in a configuration in which ejection abnormality is detected on the basis of residual vibration generated by driving a pressure generation unit, and a method of controlling the liquid ejecting apparatus.

According to an aspect of the invention, there is provided a liquid ejecting apparatus including a nozzle that ejects a liquid, a pressure chamber that communicates with the nozzle, an operation unit that constitutes a portion of the pressure chamber, a liquid ejecting head that has a pressure generation unit for deforming the operation unit and ejects the liquid from the nozzle in association with the driving of the pressure generation unit, a driving pulse generation unit that generates a driving pulse for generating pressure vibration within the pressure chamber by driving the pressure generation unit, and an inspection unit that inspects ejection abnormality on the basis of the vibration of the operation unit which is generated in association with the driving of the pressure generation unit. The driving pulse generation unit generates an ejection driving pulse for forming a dot on a landing object by ejecting the liquid from the nozzle and an inspection driving pulse for generating pressure vibration at the time of inspection through the inspection unit, and generates a plurality of vibration damping driving pulses for damping the vibration of the liquid which is generated in association with the ejection of the liquid through the ejection driving pulse, between the inspection driving pulse and the ejection driving pulse.

In this case, the plurality of vibration damping driving pulses for damping the vibration of the operation unit at the time of the ejection of the liquid which is generated by the ejection driving pulse are provided between the inspection driving pulse and the ejection driving pulse, and thus the vibration of the liquid, which is generated within the pressure chamber in association with the ejection of the liquid through the ejection driving pulse in a period immediately before an ejection abnormality inspection is performed, is damped by the vibration damping driving pulses. In addition, the plurality of vibration damping driving pulses are provided, and thus it is possible to converge the vibration of the liquid more rapidly and gradually. For this reason, it is possible to prevent a current based on a counter electromotive force generated due to the vibration of the liquid from going around to the inspection unit side. As a result, it is possible to improve the detection accuracy of ejection abnormality.

In addition, in the above-mentioned configuration, it is preferable that a driving voltage of a vibration damping driving pulse generated later be set to be lower than a driving voltage of the vibration damping driving pulse generated previously, among the plurality of vibration damping driving pulses.

In this case, since the driving voltage of the vibration damping driving pulse generated later is set to be lower than the driving voltage of the vibration damping driving pulse generated previously, it is possible to damp vibration, which is generated in accordance with the previous vibration damping driving pulse, by the later vibration damping driving pulse without generating vibration more than necessary. Thus, it is possible to perform the damping more rapidly.

Furthermore, in the above-mentioned configuration, the ejection driving pulse includes a first change element having a potential changing so as to expand the pressure chamber and a second change element which is generated after the first change element and has a potential changing so as to contract the pressure chamber. The vibration damping driving pulse includes a third change element having a potential changing so as to expand the pressure chamber and a fourth change element which is generated after the third change element and has a potential changing so as to contract the pressure chamber. It is preferable that a time from a starting point of the second change element of the ejection driving pulse to a starting point of the third change element of the first vibration damping driving pulse of the plurality of vibration damping driving pulses be set to a natural number times an intrinsic vibration period Tc occurring in the liquid within the pressure chamber and that a time from a starting point of the fourth change element of the vibration damping driving pulse generated previously to a starting point of the third change element of the vibration damping driving pulse generated subsequently thereto be set to a natural number times the intrinsic vibration period Tc occurring in the liquid within the pressure chamber.

In this case, with regard to the first vibration damping driving pulse among the plurality of vibration damping driving pulses, the third change element is applied to the pressure generation unit at a timing capable of damping the vibration of liquid which is generated by the ejection driving pulse. With regard to a driving voltage of a vibration damping driving pulse generated later, the third change element is applied to the pressure generation unit at a timing capable of damping the vibration of liquid which is generated by the vibration damping driving pulse generated previously. Thus, it is possible to damp the vibration of liquid more appropriately.

According to another aspect of the invention, there is provided a method of controlling a liquid ejecting apparatus including a nozzle that ejects a liquid, a pressure chamber that communicates with the nozzle, a liquid ejecting head that has a pressure generation unit, which deforms an operation unit for sealing an opening surface of the pressure chamber, and ejects the liquid from the nozzle in association with the driving of the pressure generation unit, a driving pulse generation unit that generates a driving pulse for generating pressure vibration within the pressure chamber by driving the pressure generation unit, and an inspection unit that inspects ejection abnormality on the basis of the vibration of liquid of the operation unit which is generated in association with the driving of the pressure generation unit. An ejection driving pulse for forming a dot on a landing object by ejecting the liquid from the nozzle and an inspection driving pulse for generating pressure vibration at the time of inspection through the inspection unit are generated, and a plurality of vibration damping driving pulses for damping the vibration of liquid at the time of the ejection of liquid, which is generated by the ejection driving pulse, are generated between the inspection driving pulse and the ejection driving pulse.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments for implementing the invention will be described with reference to the accompanying drawings. Meanwhile, various limits are made for preferred specific examples of the invention in the embodiments described below. However, the scope of the invention is not limited to those embodiments as long as there is particularly no disclosure to limit the invention in the following description. In addition, hereinafter, an ink jet type recording apparatus (hereinafter, a printer) will be described as an example of a liquid ejecting apparatus of the invention.

Figure 1:
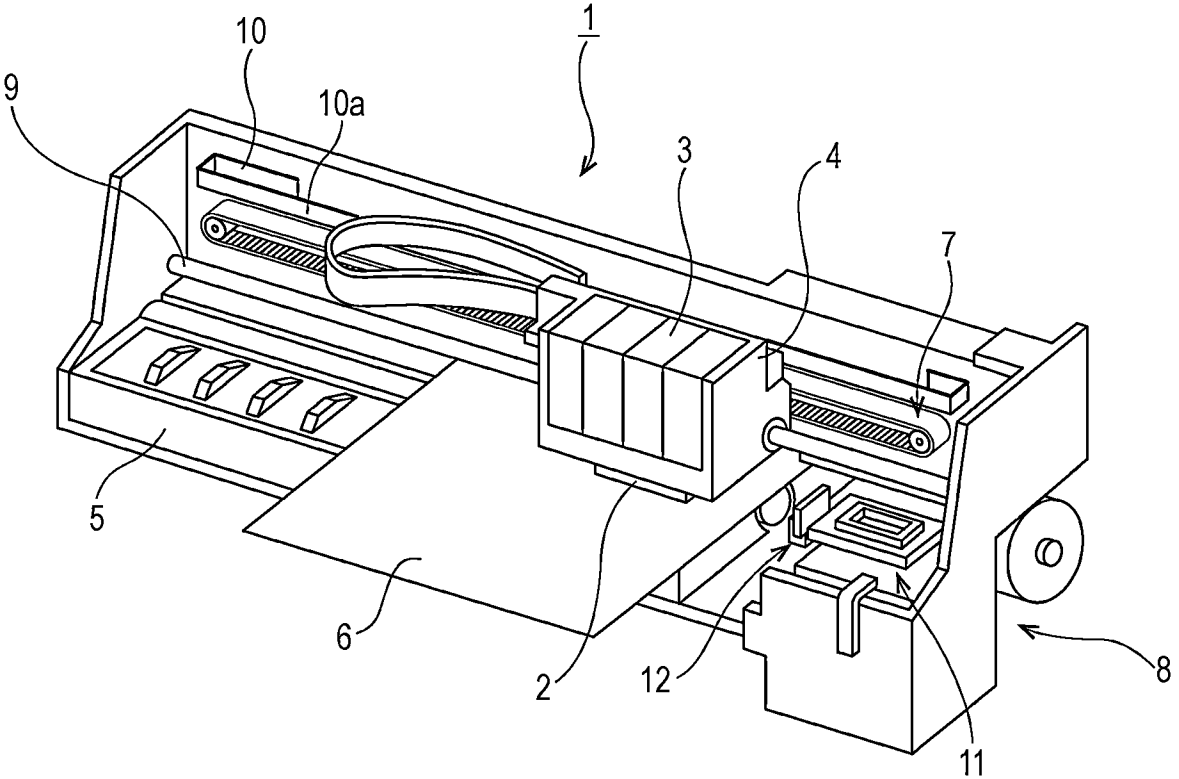
FIG. 1 is a perspective view illustrating a configuration of a printer.

FIG. 1 is a perspective view illustrating a configuration of a printer 1. The printer 1 schematically includes a carriage 4 that has a recording head 2, which is a kind of liquid ejecting head, mounted thereto and an ink cartridge 3, which is a kind of liquid supply source, detachably mounted thereto, a platen 5 that is disposed below the recording head 2 at the time of a recording operation, a carriage moving mechanism 7 that reciprocates the carriage 4 in a width direction of a recording paper 6 (a kind of recording medium and landing object), that is, in a main scanning direction, and a paper feeding mechanism 8 that transports the recording paper 6 in a sub-scanning direction perpendicular to the main scanning direction.

The carriage 4 is axially supported by and mounted to a guide rod 9 that is laid in the main scanning direction, and is configured to move in the main scanning direction along the guide rod 9 in accordance with the operation of the carriage moving mechanism 7. The position of the carriage 4 in the main scanning direction is detected by a linear encoder 10, and a detection signal thereof, that is, an encoder pulse (a kind of positional information), is transmitted to a control unit 37 (see FIG. 4) of a printer controller 31. The linear encoder 10 is a kind of positional information output unit, and outputs the encoder pulse according to a scanning position of the recording head 2 as positional information in the main scanning direction. For this reason, the control unit 37 can recognize the scanning position of the recording head 2 which is mounted to the carriage 4, on the basis of the received encoder pulse. That is, for example, it is possible to recognize the position of the carriage 4 by counting the received encoder pulses. Thus, the control unit 37 can control a recording operation through the recording head 2 while recognizing the scanning position of the carriage 4 (the recording head 2) on the basis of the encoder pulse that is output from the linear encoder 10.

A home position serving as a base point of the scanning of the carriage is set in an end region that is located further outside than a recording region within a movement range of the carriage 4. The home position in this embodiment is provided with a capping member 11 that seals a nozzle forming surface (a nozzle plate 29, see FIG. 3) of the recording head 2 and a wiper member 12 for wiping the nozzle forming surface. The printer 1 is configured to be capable of so-called bidirectional recording for recording characters or images on the recording paper 6 bidirectionally, both in a forward motion when the carriage 4 moves toward an end on the opposite side from the home position and in a backward motion when the carriage 4 returns to the home position side from the end on the opposite side.

Figure 2:
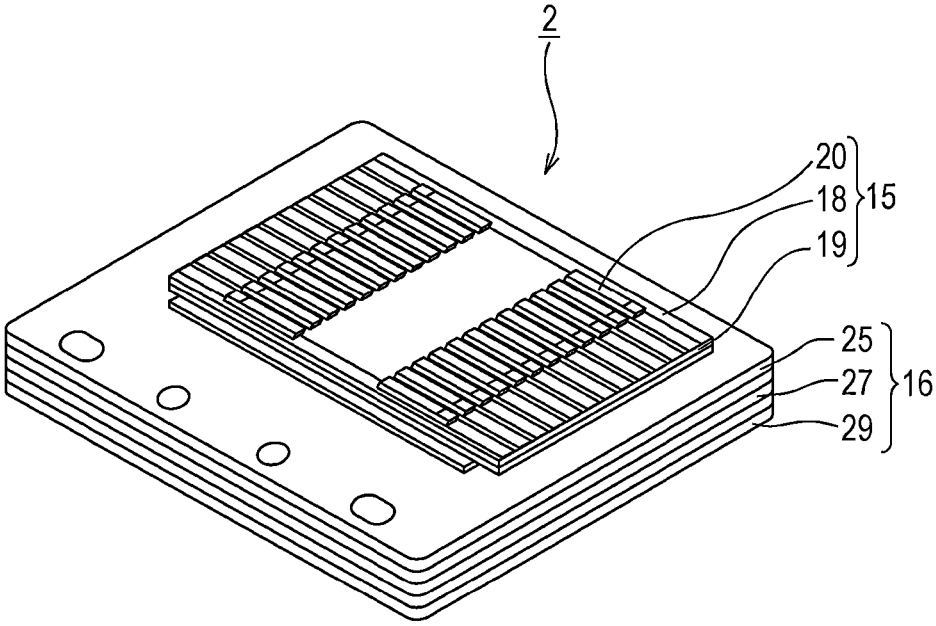
FIG. 2 is a perspective view illustrating a configuration of a recording head.
Figure 3:
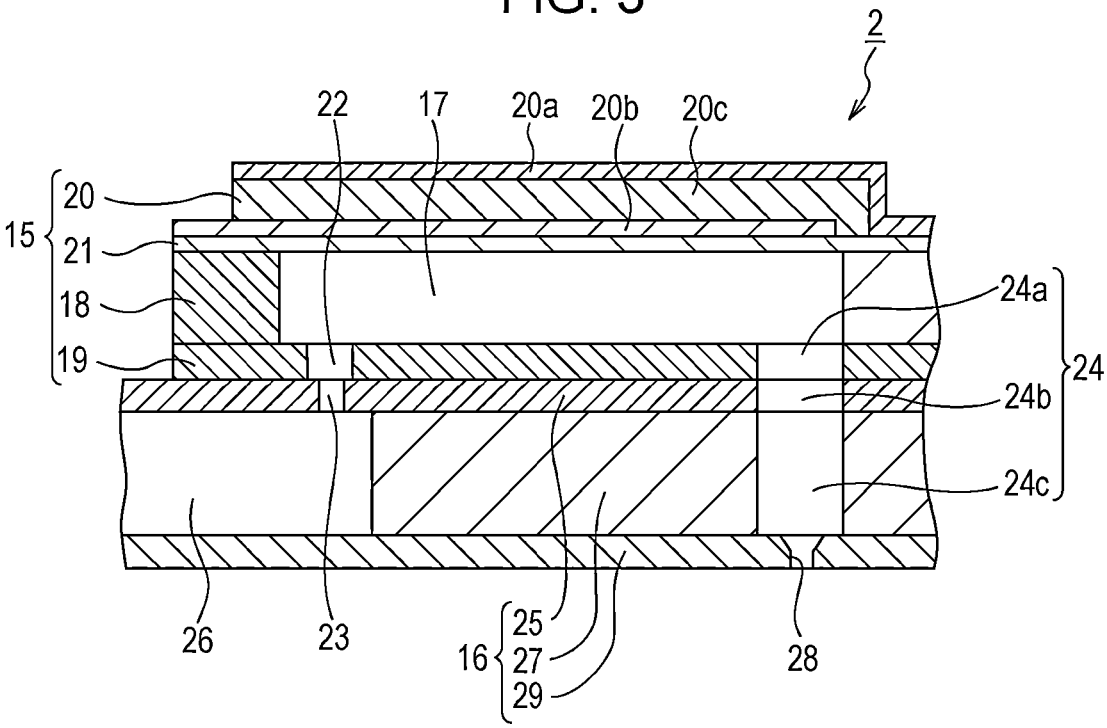
FIG. 3 is a partial cross-sectional view of the recording head.

As illustrated in FIG. 2 and FIG. 3, the recording head 2 includes a pressure generation unit 15 and a flow channel unit 16, and is integrally formed in a state where the pressure generation unit and the flow channel unit are superimposed on each other. The pressure generation unit 15 is configured in such a manner that a pressure chamber plate 18 for partitioning a pressure chamber 17, a communication port plate 19 having a communication port 22 on the supply side and a first communication port 24*a* being opened therein, and a vibration plate 21 having a piezoelectric element 20 mounted thereon are stacked on each other and integrated through baking. In addition, the flow channel unit 16 is configured in such a manner that plate members, which are constituted by supply port plate 25 having a supply port 23 and a second communication port 24*b* formed therein, a reservoir plate 27 having a reservoir 26 and a third communication port 24*c* formed therein, and a nozzle plate 29 having a nozzle 28 formed therein, are attached to each other in a stacking state. The nozzle plate 29 includes a nozzle array in which a plurality of the nozzles 28 (for example, 360 nozzles) are arranged. For example, the nozzle array is provided for each color of ink (a kind of liquid).

The piezoelectric element 20 is disposed on the outer surface of the vibration plate 21 which is the opposite side of the pressure chamber 17 so as to correspond to each pressure chamber 17. The exemplified piezoelectric element 20 is a piezoelectric element in a so-called flexural vibration mode, and includes a driving electrode 20*a*, a common electrode 20*b*, and a piezoelectric layer 20*c* interposed between the driving electrode and the common electrode. When a driving signal (driving pulse) is applied to a driving electrode of the piezoelectric element 20, an electric field is generated between the driving electrode 20*a* and the common electrode 20*b* due to a potential difference. The electric field is applied to the piezoelectric layer 20*c*, which is deformed in accordance with the strength of the electric field applied to the piezoelectric layer 20*c*. That is, as a potential of the driving electrode 20*a* increases, a central portion of the piezoelectric layer 20*c* in a width direction (a direction of the nozzle array) bends toward the inside of the pressure chamber 17 (the side coming close to the nozzle plate 29), thereby deforming the vibration plate 21 so as to reduce the volume of the pressure chamber 17. On the other hand, as the potential of the driving electrode 20*a* decreases (as the potential thereof comes close to 0), a central portion of the piezoelectric layer 20*c* in a longitudinal direction bends toward the outside of the pressure chamber 17 (the side away from the nozzle plate 29), thereby deforming the vibration plate 21 so as to increase the volume of the pressure chamber 17. Here, in the vibration plate 21, a portion that seals an opening of the pressure chamber 17 functions as an operation unit in the invention. An area of the operation unit is slightly larger than an area of the opening of the pressure chamber 17 which is sealed by the operation unit. Thus, the operation unit can be easily bent further inside or outside than an opening surface of the pressure chamber 17. Meanwhile, in the exemplified configuration, it is also possible to employ a configuration in which the driving electrode 20*a* and the common electrode 20*b* are reversed.

Figure 4:
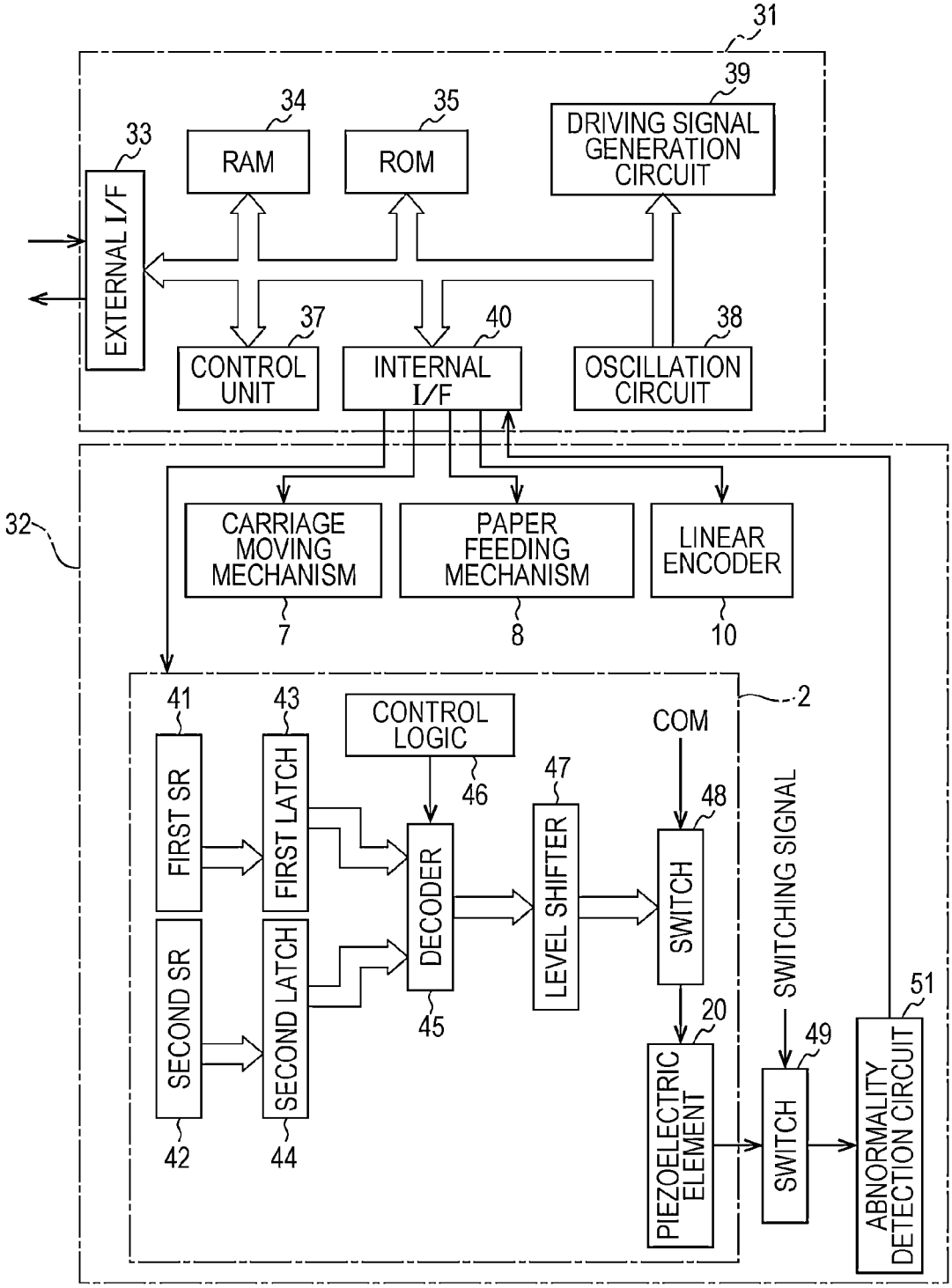
FIG. 4 is a block diagram illustrating an electrical configuration of a printer.

FIG. 4 is a block diagram illustrating an electrical configuration of the printer 1. The printer 1 of this embodiment schematically includes a printer controller 31 and a print engine 32. The printer controller 31 includes an external interface (external I/F) 33 to which printing data or the like is input from an external device such as a host computer, a RAM 34 that stores various pieces of data or the like, a ROM 35 that stores a control program or the like for various types of control operations, the control unit 37 that generally controls units in accordance with the control program that is stored in the ROM 35, an oscillation circuit 38 that generates a clock signal, a driving signal generation circuit 39 (a kind of driving pulse generation unit) which generates a driving signal to be supplied to the recording head 2, and an internal interface (internal I/F) 40 for outputting dot pattern data, which is obtained by developing printing data for each dot, or the driving signal to the recording head 2. In addition, the print engine 32 includes the recording head 2, the carriage moving mechanism 7, the paper feeding mechanism 8, and the linear encoder 10.

The control unit 37 functions as a timing pulse generation unit that generates a timing pulse PTS (see FIG. 5) from the encoder pulse that is output from the linear encoder 10. The timing pulse PTS is a signal for determining a generation starting timing of the driving signal that is generated by the driving signal generation circuit 39. That is, the driving signal generation circuit 39 outputs a driving signal COM whenever receiving the timing pulse PTS. In other words, the driving signal generation circuit 39 repeatedly generates the driving signal COM with a period (hereinafter, referred to as a unit period T) based on the above-mentioned timing pulse PTS. In addition, the control unit 37 outputs a latch signal LAT for specifying a latch timing of printing data and a change signal CH for specifying a selection timing of each ejection driving pulse included in the driving signal. Meanwhile, the latch signal LAT of this embodiment generates a first LAT1 by receiving the timing pulse PTS and then generates a second LAT2 on condition that a specified time has elapsed.

The driving signal generation circuit 39 is constituted by a driving voltage supply source and a constant voltage supply source (both are not shown in the drawing). The driving signal generation circuit outputs the above-mentioned driving signal COM from the driving voltage supply source and outputs a direct current voltage VBS from the constant voltage supply source. The driving voltage supply source is electrically connected to the driving electrode 20*a* of the piezoelectric element 20 through a first switch 48 provided for each piezoelectric element 20 (see FIGS. 7A and 7B). In addition, the constant voltage supply source is electrically connected to the common electrode 20*b* of the piezoelectric element 20 through a second switch 49, which is commonly provided with respect to the piezoelectric elements 20 belonging to the same nozzle array, and a detection resistor 50 that is connected in parallel to the second switch 49 (see FIGS. 7A and 7B).

Figure 5:
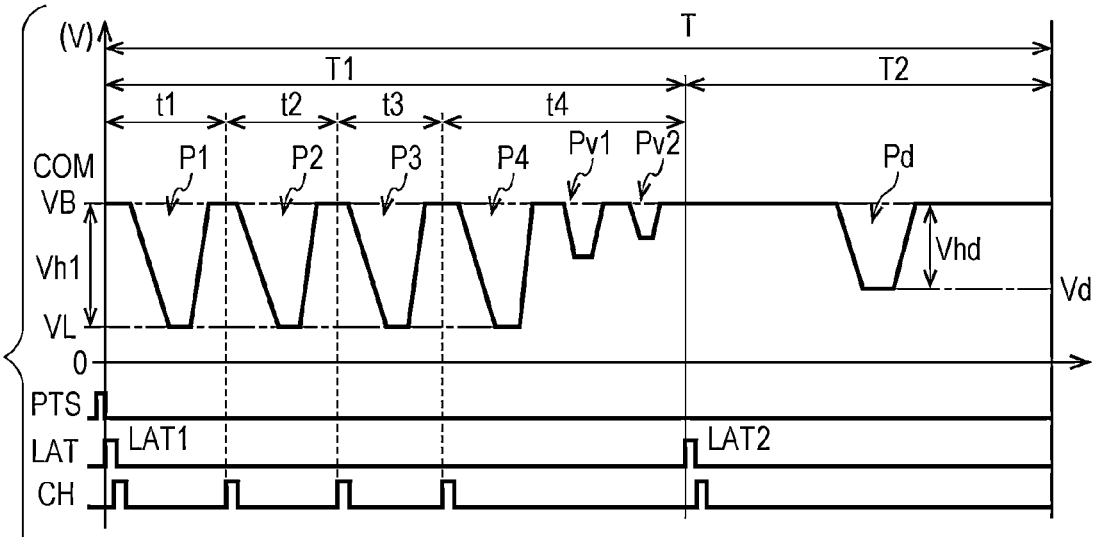
FIG. 5 is a pulse diagram illustrating a configuration of a driving signal and a correspondence table of pulse selection data.

FIG. 5 is a pulse diagram illustrating an example of a configuration of the driving signal COM and a correspondence table of pulse selection data according to this embodiment. Meanwhile, in FIG. 5, a horizontal axis represents time, and a vertical axis represents a potential. The driving signal COM of this embodiment can be divided into a first half portion and a second half portion based on the latch signal. In this embodiment, a portion corresponding to a first half (period T1) is a unit signal for recording, and a portion corresponding to a second half (period T2) is a unit signal for inspection. In this embodiment, it is possible to perform an ejection abnormality inspection of the nozzle 28 by using the unit signal for inspection of the second half during a recording operation (during a printing operation of an image or the like) which is performed on a recording medium such as the recording paper 6. The ejection abnormality inspection will be described later in detail.

The unit signal for recording in this embodiment is a series of signals having four ejection driving pulses (a kind of ejection driving pulse in the invention) P1 to P4 and vibration damping driving pulses (a kind of vibration damping driving pulse in the invention) Pv1 and Pv2 described below, within the period T1. In this embodiment, the period T1 of the first half portion is divided into four periods (pulse generation periods) t1 to t4. The first ejection driving pulse P1 is generated in the period t1, the second ejection driving pulse P2 is generated in the period t2, and the third ejection driving pulse P3 is generated in the period t3. In addition, in the period t4, the fourth ejection driving pulse P4, the first vibration damping driving pulse Pv1, and the second vibration damping driving pulse Pv2 are generated. The ejection driving pulses P1 to P4 become pulses having a potential changing to a reverse trapezoidal shape between a reference potential VB and an ejection potential VL that is lower than the reference potential. A driving voltage Vh1 (a potential difference between the reference potential VB and the ejection potential VL) of each of the ejection driving pulses P1 to P4 is set to such a value that a predetermined amount of ink is ejected from the nozzle 28. In this embodiment, a total of four grayscales including non-recording in which no dot is formed can be expressed with respect to a forming region of one pixel (a constituent unit of an image or the like).

More specifically, whenever each of the first ejection driving pulse P1 to the fourth ejection driving pulse P4 is applied to the piezoelectric element 20, a specified amount of ink is ejected from the nozzle 28. In addition, it is possible to differentiate sizes of dots, which are recorded in one pixel region (a virtual pixel forming region of the recording paper 6), from each other by changing the number of ejection driving pulses to be applied to the piezoelectric element 20 within the period T1. The ejection driving pulses are selected within the period T1 in accordance with 2 bits of selection data that is generated on the basis of the printing data, as illustrated in a left-hand column (LAT1) in the correspondence table of FIG. 5.

For example, when the selection data is (00), no ejection driving pulse is applied to the piezoelectric element 20. For this reason, ink is not ejected from the nozzle 28 in the period T1. That is, when the selection data is (00), non-recording (non-ejection) in which no dot is formed occurs. In addition, when the selection data is (01) in the period T1, only the second ejection driving pulse P2 in the period t2 within the period T1 is applied to the piezoelectric element 20, and thus ink is ejected only once from the nozzle 28 in the period T1. Thus, one dot (hereinafter, referred to as a unit dot) is formed on the recording paper 6, and this becomes a small dot. Furthermore, when the selection data is (10), the first ejection driving pulse P1 in the period t1 and the third ejection driving pulse P3 in the period t3 within the period T1 are selected and sequentially applied to the piezoelectric element 20. Thus, an ejection operation of ink is performed twice in a row within the period T1. When these pieces of ink are landed on the recording paper 6, two unit dots are formed on the recording paper 6, and a medium dot is constituted by the two unit dots. When the selection data is (11), the four ejection driving pulses P1 to P4 within the period T1 are selected and sequentially applied to the piezoelectric element 20, and thus an ejection operation of ink is performed four times in a row within the period T1. Thus, each piece of ink is landed on the recording paper 6 to thereby form four unit dots, thereby constituting a large dot by these unit dots.

Here, the fourth ejection driving pulse P4 that is generated in the final period t4 of the period T1 among the plurality of ejection driving pulses P1 to P4 is paired with the first vibration damping driving pulse Pv1 and the second vibration damping driving pulse Pv2 that are generated similarly in the period t4. Therefore, when the fourth ejection driving pulse P4 is selected and applied to the piezoelectric element 20, subsequently thereto, the first vibration damping driving pulse Pv1 and the second vibration damping driving pulse Pv2 are also sequentially applied to the piezoelectric element 20.

Figure 6:
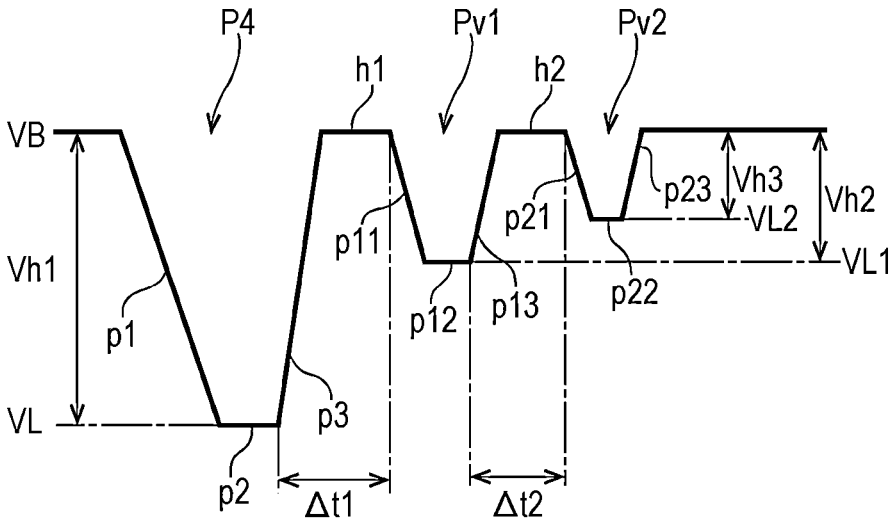
FIG. 6 is a pulse diagram illustrating configurations of a fourth ejection driving pulse, a first vibration damping driving pulse, and a second vibration damping driving pulse.

FIG. 6 is a pulse diagram illustrating configurations of the fourth ejection driving pulse P4, the first vibration damping driving pulse Pv1, and the second vibration damping driving pulse Pv2.

The fourth ejection driving pulse P4 is a driving pulse constituted by the same pulses as other ejection driving pulses P1 to P3, and is a voltage pulse that includes a first expansion element p1 (corresponds to a first change element in the invention) having a potential changing (dropping) from the reference potential VB to the ejection potential VL which is a minimum potential, an expansion hold element p2 having a constant potential at the ejection potential VL, and a first contraction element p3 (corresponds to a second change element in the invention) having a potential changing (rising) from the ejection potential VL to the reference potential VB.

In addition, the first vibration damping driving pulse Pv1 is a voltage pulse that includes a second expansion element p11 (corresponds to a third change element in the invention) having a potential changing (dropping) from the reference potential VB to a first vibration damping potential VL1, an expansion hold element p12 having a constant potential at the first vibration damping potential VL1, and a second contraction element p13 (corresponds to a fourth change element in the invention) having a potential changing (rising) from the first vibration damping potential VL1 to the reference potential VB. In addition, the second vibration damping driving pulse Pv2 is a voltage pulse that has a third expansion element p21 (corresponds to the third change element in the invention) having a potential changing (dropping) from the reference potential VB to a second vibration damping potential VL2, an expansion hold element p22 having a constant potential at the second vibration damping potential VL2, and a fourth contraction element p23 (corresponds to the fourth change element in the invention) having a potential changing (rising) from the second vibration damping potential VL2 to the reference potential VB.

The above-mentioned first vibration damping driving pulse Pv1 is a driving pulse for damping residual vibration after ink is ejected in accordance with the fourth ejection driving pulse P4. In order to offset the residual vibration, a timing at which the second expansion element p11 is applied to the piezoelectric element 20 is important. Specifically, it is necessary to set a timing of the second expansion element p11 so as to generate vibration having an opposite phase to the residual vibration. For this reason, a time $\Delta t1$ from a starting point of the first contraction element p3 of the fourth ejection driving pulse P4 which is a timing at which the excitation of the pressure vibration, which is necessary for the ejection of ink, is started, to a starting point of the second expansion element p11 of the first vibration damping driving pulse Pv1 is set to $\Delta t1 = n \times Tc$ (n: natural number) when setting a period (intrinsic vibration period) of pressure vibration generated in ink within the pressure chamber 17 to Tc.

Here, the above-mentioned Tc can be generally expressed by the following expression.

$$Tc=2\pi\sqrt{[(Mn+Ms)/(Mn\times Ms\times(Cc+Ci))]}$$

In the above expression, Mn denotes inertance (mass of ink per unit area) in the nozzle 28, Ms denotes inertance in the ink supply ports 22 and 23, Cc denotes compliance (indicating a variation in volume per unit pressure and the degree of flexibility) of the pressure chamber 17, and Ci denotes compliance (Ci=volume V/[intensity ρ×sound velocity c2]) of ink.

In addition, a driving voltage Vh2 (a potential difference between the reference potential VB and the first vibration damping potential VL1) of the first vibration damping driving pulse Pv1 is set to a value within the following range, with respect to the driving voltage Vh1 of the fourth ejection driving pulse P4.

$$0.2\times Vh1\leq Vh2\leq 0.4\times Vh1$$

An appropriate value of the driving voltage Vh2 fluctuates depending on ink viscosity, environmental temperature or humidity, or the like, but is set to a value within the above-mentioned range, and thus it is possible to suppress the residual vibration after the ejection of ink roughly to the extent of there being no problem.

In addition, the second vibration damping driving pulse Pv2 is a driving pulse for suppressing the vibration excited by the second contraction element p13 of the first vibration damping driving pulse Pv1. For this reason, a time Δt2 from a starting point of the second contraction element p13 of the first vibration damping driving pulse Pv1 to a starting point of the third expansion element p21 of the second vibration damping driving pulse Pv2 is set to a natural number times Tc. In addition, a driving voltage Vh3 (a potential difference between the reference potential VB and the second vibration damping potential VL2) of the second vibration damping driving pulse Pv2 is set to a value within the following range, with respect to the driving voltage Vh1 of the fourth ejection driving pulse P4.

$$0.1\times Vh1\leq Vh3\leq 0.2\times Vh1$$

That is, the driving voltage Vh3 of the second vibration damping driving pulse Pv2 which is generated later is set to be lower than the driving voltage Vh2 of the first vibration damping driving pulse Pv1 which is generated previously. Thus, it is possible to damp vibration generated by the vibration damping driving pulse on the front side without generating vibration more than necessary. Thus, it is possible to perform the damping more rapidly.

The second vibration damping driving pulse Pv2 that is configured in this manner can suppress the vibration generated due to the second contraction element p13 of the first vibration damping driving pulse Pv1. In this manner, it is possible to converge the residual vibration more rapidly and appropriately by damping the residual vibration in stages by the plurality of vibration damping driving pulses. That is, the first vibration damping driving pulse Pv1 is set to more reliably damp the residual vibration generated in association with the ejection of ink through the fourth ejection driving pulse P4, and the residual vibration generated by the first vibration damping driving pulse Pv1 is damped by the second vibration damping driving pulse Pv2 at a subsequent stage, and thus it is possible to converge the residual vibration more rapidly than the case of a single vibration damping driving pulse. In the case of the single vibration damping driving pulse, time until the residual vibration generated by the vibration damping driving pulse is converged needs to be set to be longer. As a result, there is a concern that a convergence time may be increased as compared with a configuration in which the first vibration damping driving pulse Pv1 and the second vibration damping driving pulse Pv2 are used as in this embodiment.

Meanwhile, in this embodiment, an example has been described in which two vibration damping driving pulses are provided between the fourth ejection driving pulse P4 and an inspection driving pulse Pd. However, the invention is not limited thereto, and three or more vibration damping driving pulses may be provided therebetween. In this case, regarding a driving voltage of each vibration damping driving pulse, a driving voltage of each vibration damping driving pulse may be set as low as a damping voltage of the vibration damping driving pulse generated later. In addition, a time from a starting point of a contraction element of a vibration damping driving pulse generated previously to a starting point of an expansion element of a vibration damping driving pulse that is generated subsequently thereto may be set to a natural number times Tc.

The unit signal for inspection in this embodiment is a series of signals having one inspection driving pulse Pd (a kind of inspection driving pulse in the invention) within the period T2. The inspection driving pulse Pd is constituted by a pulse having a potential changing to a reverse trapezoidal shape between the reference potential VB and an inspection potential Vd that is lower than the reference potential. That is, the inspection driving pulse Pd is a pulse causing the piezoelectric element 20 to perform a series of operations including bending toward the outside of the pressure chamber 17 from a reference state corresponding to the reference potential VB to thereby expand the volume of the pressure chamber 17 and then bending toward the inside of the pressure chamber 17 to thereby contract the volume of the pressure chamber 17 up to a reference volume corresponding to the reference potential VB.

A driving voltage Vhd (a potential difference between the reference potential VB and the ejection potential Vd) of the inspection driving pulse Pd is set to be lower than the driving voltage Vh1 of the ejection driving pulse and to be higher than the driving voltages Vh2 and Vh3 of the vibration damping driving pulses. The inspection driving pulse Pd is a pulse intended to generate pressure vibration in ink within the pressure chamber 17 by driving the piezoelectric element 20. For this reason, ink may be or may not be ejected from the nozzle 28 when the piezoelectric element 20 is driven by the application of the inspection driving pulse Pd. However, in this embodiment, since an ejection abnormality inspection of the nozzle 28 is performed during a recording operation, the driving voltage Vhd is set to such a driving voltage Vh2 that ink is not ejected from the nozzle 28 even though the inspection driving pulse Pd is applied to the piezoelectric element 20.

The selection of the inspection driving pulse Pd in an ejection abnormality inspection mode (period T2) is performed on the basis of 2 bits of selection data, similar to the selection of the ejection driving pulse of the period T1. In this embodiment, for example, when the detection of ejection abnormality is not performed (non-detection), selection data (00) is allocated. That is, when the selection data is (00), the inspection driving pulse Pd is not applied to the piezoelectric element 20 in the period T2. In addition, when a nozzle to be inspected is driven, selection data (01) is allocated. In this case, the inspection driving pulse Pd is applied to the piezoelectric element 20 corresponding to the nozzle to be inspected in the period T2. Meanwhile, in the ejection abnormality inspection mode of this embodiment, pieces of selection data (10) and (11) are not used.

Next, an electrical configuration of the recording head 2 will be described. As illustrated in FIG. 4, the recording head 2 includes a shift register (SR) circuit constituted by a first shift register 41 and a second shift register 42, a latch circuit constituted by a first latch circuit 43 and a second latch circuit 44, a decoder 45, a control logic 46, a level shifter 47, a switch 48 (first switch), the piezoelectric element 20, the switch 49 (second switch), and an ejection abnormality detection circuit 51. In addition, numbers of shift registers 41 and 42, latch circuits 43 and 44, level shifter 47, first switch 48, and piezoelectric element 20 which correspond to the number of nozzles 28 are provided. Meanwhile, FIG. 4 illustrates only a configuration corresponding to one nozzle, and configurations corresponding to other numbers of nozzles are not illustrated.

The recording head 2 controls the ejection of ink on the basis of selection data (gray-scale data) SI that is transmitted from the printer controller 31. In this embodiment, the selection data is transmitted in synchronization with a clock signal CLK to the recording head 2 in the order of a higher-order bit group of the selection data constituted by 2 bits and a lower-order bit group of the selection data, and thus the higher-order bit group of the selection data is first set to the second shift register 42. When the higher-order bit group of the selection data is set to the second shift register 42 with respect to all the nozzles 28, the higher-order bit group is subsequently shifted to the first shift register 41. At the same time, the lower-order bit group of the selection data is set to the second shift register 42.

The first latch circuit 43 is electrically connected downstream of the first shift register 41, and the second latch circuit 44 is electrically connected downstream of the second shift register 42. In addition, when a latch pulse is input to each of the latch circuits 43 and 44 from the printer controller 31 side, the first latch circuit 43 latches a higher-order bit group of recording data, and the second latch circuit 44 latches a lower-order bit group of the recording data. The pieces of recording data (the higher-order bit group and the lower-order bit group) which are respectively latched by the latch circuits 43 and 44 are output to the decoder 45. The decoder 45 generates pulse selection data for selecting each driving pulse included in the driving signal COM, on the basis of the higher-order bit group and the lower-order bit group of the recording data.

The driving signal COM is supplied to the input side of the first switch 48 from the driving signal generation circuit 39. In addition, the driving electrode 20*a* of the piezoelectric element 20 is connected to the output side of the first switch 48 (see FIGS. 7A and 7B). The first switch 48 selectively supplies a driving pulse included in each driving signal to the piezoelectric element 20, on the basis of the above-mentioned selection data. The first switch 48, which performs such an operation, functions as a kind of selection supply unit.

On the other hand, the ejection abnormality detection circuit 51 is connected to the common electrode 20*b* side of the piezoelectric element 20 through the second switch 49. The second switch 49 is switching-controlled in response to a switching signal that is output from the control logic 46. The ejection abnormality detection circuit 51 is configured to output a counter electromotive force signal of the piezoelectric element 20 based on residual vibration when the piezoelectric element 20 is driven by the inspection driving pulse Pd, as a detection signal, to the printer controller 31 side. The printer controller 31 (the control unit 37) inspects for the presence or absence of ejection abnormality of a nozzle to be inspected, on the basis of the counter electromotive force signal that is output from the ejection abnormality detection circuit 51. Therefore, the ejection abnormality detection circuit 51 and the printer controller 31 function as an inspection unit in the invention.

Figure 7A:
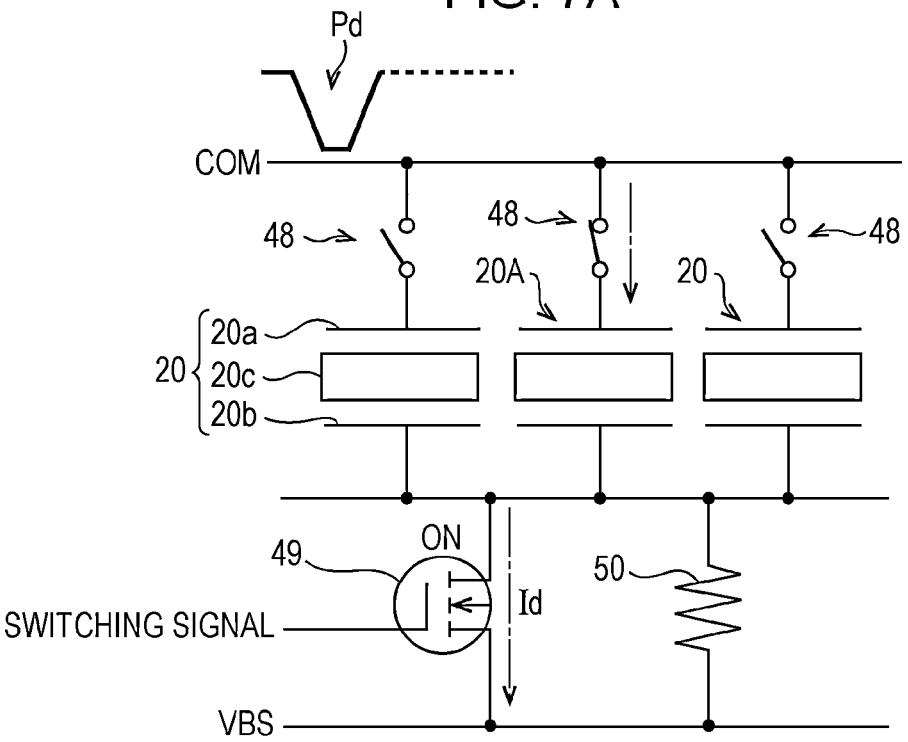
FIGS. 7A and 7B are diagrams illustrating a circuit configuration for detecting a counter electromotive force signal of a piezoelectric element.
Figure 7B:
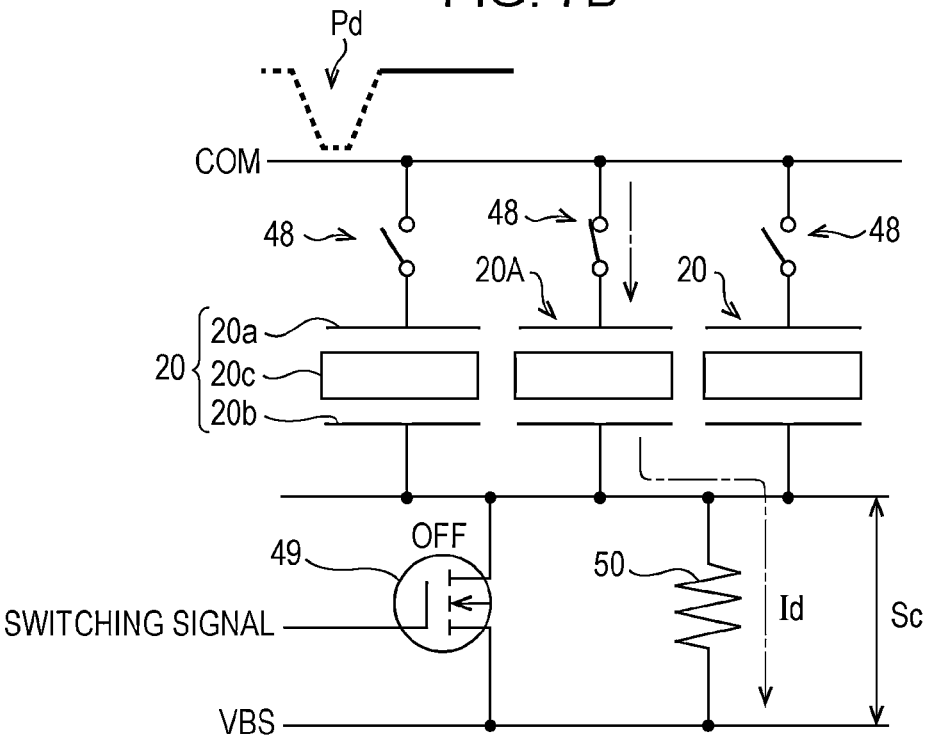

FIGS. 7A and 7B are diagrams illustrating a circuit configuration for detecting a counter electromotive force signal Sc of the piezoelectric element 20. Meanwhile, FIGS. 7A and 7B illustrate a configuration corresponding to three nozzles, and for convenience of description, configurations corresponding to other numbers of nozzles 28 are not illustrated. However, numbers of piezoelectric elements 20 and first switches 48 which correspond to the number of nozzles 28 constituting the same nozzle array are provided. In addition, in FIGS. 7A and 7B, the central piezoelectric element 20 is the piezoelectric element 20 corresponding to a nozzle to be inspected (first nozzle). As described above, a driving voltage supply source of the driving signal generation circuit 39 is connected to the driving electrode 20*a* of the piezoelectric element 20 through the first switch 48 for each piezoelectric element 20, and a constant voltage supply source is electrically connected to the common electrode 20*b* of the piezoelectric element 20 through the second switch 49 and the detection resistor 50 that is connected in parallel to the second switch 49. The second switch 49 is constituted by, for example, a MOS-FET, and is switched to an on-state during a recording operation in the period T1 or during application (a pressure vibration generation period) of the inspection driving pulse Pd in the period T2 (FIG. 7A). In this case, a current Id flows through the second switch 49 side. On the other hand, the second switch is switched to an off-state in a detection period immediately after the inspection driving pulse Pd is applied in the period T2 (FIG. 7B). In this case, the current Id flows through the detection resistor 50 side.

Here, after the piezoelectric element 20 is driven by the inspection driving pulse Pd, the vibration plate 21 which is an operation unit of the pressure chamber 17 vibrates in accordance with the pressure vibration generated in ink within the pressure chamber 17. Consequently, damping vibration (residual vibration) is also generated in the piezoelectric element 20, and a counter electromotive force based on the residual vibration is generated. The ejection abnormality detection circuit 51 obtains the counter electromotive force signal Sc (detection signal) of the piezoelectric element 20 by amplifying and binarizing a potential difference between both ends of the above-mentioned detection resistor 50. It can be seen that, at the time of abnormality such as a case of a so-called dot omission in which ink is not ejected from the nozzle 28 or a case where an amount or flying speed of ink is extremely decreased as compared with a normal nozzle 28 even though ink is ejected from the nozzle 28, phase components based on a period component, an amplitude component, and a latch signal (LAT2) of the above-mentioned detection signal are different from those at the time of normality. For this reason, the determination of ejection abnormality based on the counter electromotive force signal Sc is performed by specifying in advance a normal range of each of the above-mentioned components and determining whether each component of the detection signal is in the specified range. Meanwhile, since a determination method is well known, a detailed description thereof will be omitted.

The ejection abnormality inspection is sequentially performed on each of the nozzles 28 constituting the nozzle array. In the ejection abnormality inspection mode in the period T2, first, the second switch 49 of the piezoelectric element 20 which corresponds to a nozzle to be inspected is turned on in response to a switching signal (a first process, FIG. 7A). Meanwhile, the first switch 48 is turned off with respect to the piezoelectric elements 20 corresponding to nozzles other than the nozzle to be inspected. This is to prevent a leak current from another piezoelectric element 20 from going around to the detection resistor 50 side when the counter electromotive force signal Sc of the piezoelectric element 20 of the nozzle to be inspected is detected.

As illustrated in FIG. 7A, in a pressure vibration generation period of a period t5, the inspection driving pulse Pd is applied to the piezoelectric element 20 corresponding to the nozzle to be inspected, on the basis of the selection data (01). At the same time, the inspection driving pulse Pd is not applied to the piezoelectric element 20 corresponding to other nozzles, on the basis of the selection data (00) (non-detection). Thus, only the piezoelectric element 20 corresponding to the nozzle to be inspected is driven (second process), and pressure vibration is generated in the pressure chamber 17 corresponding to the nozzle to be inspected. The vibration plate 21 and the piezoelectric element 20, which are operation units of the pressure chamber 17, vibrate in association with damping vibration (residual vibration) of the pressure vibration, and thus a counter electromotive force is generated in the piezoelectric element 20 due to the vibration.

Subsequently, the second switch 49 is switched to an off-state in response to a switching signal (third process, FIG. 7B). Thus, the current Id based on the counter electromotive force of the piezoelectric element 20 corresponding to the nozzle to be inspected flows to the detection resistor 50. The ejection abnormality detection circuit 51 obtains the counter electromotive force signal Sc of the piezoelectric element 20 from a potential difference between both ends of the above-mentioned detection resistor 50. The presence or absence of abnormality of the nozzle 28 is determined on the basis of the counter electromotive force signal Sc (fourth process).

In this manner, in the printer 1 according to the invention, the vibration damping driving pulses Pv1 and Pv2 are provided between the fourth ejection driving pulse P4, which is an ejection driving pulse generated at the end of the period T1, and the inspection driving pulse Pd subsequent thereto in the period T2, and thus the residual vibration, which is generated within the pressure chamber 17 in association with the ejection of ink through the fourth ejection driving pulse P4 in the period T1 immediately before the ejection abnormality inspection mode in the period T2, is damped by the vibration damping driving pulses Pv1 and Pv2. For this reason, it is possible to prevent the current based on the counter electromotive force that is generated due to the residual vibration from going around to the detection resistor 50 side. In addition, the residual vibration generated in the pressure chamber 17 corresponding to other nozzles is similarly damped by the vibration damping driving pulses Pv1 and Pv2, and thus the residual vibration is prevented from going around toward the nozzle to be inspected through the vibration plate 21. Therefore, it is possible to improve the detection accuracy of ejection abnormality in the printer 1 of the invention.

Meanwhile, since the vibration resulting from an ejection driving pulse generated prior to the fourth ejection driving pulse P4 in the period T1 has a relatively long time up to the inspection driving pulse Pd in the period T2 and thus is naturally converged in the meantime, there is no problem. However, when there is a concern that the residual vibration generated by the ejection driving pulse, which is generated before the fourth ejection driving pulse P4, may cause a negative influence on the ejection abnormality inspection, the above-mentioned vibration damping driving pulse may be provided immediately after the ejection driving pulse.

In addition, the invention is not limited to a printer as long as it is a liquid ejecting apparatus having a configuration in which ejection abnormality is detected on the basis of residual vibration generated by driving a pressure generation unit, and the invention can also be applied to various types of ink jet type recording apparatuses such as a plotter, a facsimile apparatus, or a copy machine, a liquid ejecting apparatus other than a recording apparatus, for example, a display manufacturing apparatus, an electrode manufacturing apparatus, or a chip manufacturing apparatus, and the like.

The entire disclosure of Japanese Patent Application No. 2012-245100, filed Nov. 7, 2012 is expressly incorporated by reference herein.

What is claimed is:

1. A liquid ejecting apparatus comprising:

a piezoelectric element;

a cavity which is filled with a liquid inside and has internal pressure increasing or decreasing by displacement of the piezoelectric element;

a nozzle that communicates with the cavity and ejects the liquid as droplets by the increase or decrease in internal pressure of the cavity;

a driving signal generation unit that generates a driving signal for displacing the piezoelectric element; and a residual vibration detection unit that detects a residual vibration signal generated in the piezoelectric element, on the basis of a variation in internal pressure of the cavity which occurs by applying the driving signal to the piezoelectric element, wherein the driving signal includes:

an ejection pulse for ejecting a liquid;

a first vibration damping pulse that suppresses residual vibration generated by the ejection pulse;

a second vibration damping pulse which is different from the first vibration damping pulse and suppresses residual vibration generated by the ejection pulse; and an inspection pulse for detecting the residual vibration signal;

wherein a potential difference with respect to a reference potential at the time of application of the second vibration damping pulse is smaller than a potential difference with respect to the reference potential at the time of application of the first vibration damping pulse.

2. The liquid ejecting apparatus according to claim 1, wherein a potential difference with respect to the reference potential at the time of application of the first vibration damping pulse is smaller than a potential difference with respect to the reference potential at the time of application of the inspection pulse, and a potential difference with respect to the reference potential at the time of application of the inspection pulse is smaller than a potential difference with respect to the reference potential at the time of application of the ejection pulse.

3. The liquid ejecting apparatus according to claim 1, wherein the ejection pulse includes a plurality of pulses including a first ejection pulse and a second ejection pulse.

4. The liquid ejecting apparatus according to claim 1, further comprising:

a plurality of first switches that are electrically connected to the driving signal generation unit for each of a plurality of the piezoelectric elements including a first piezoelectric element and a second piezoelectric element, and select whether to apply the driving signal; and a second switch that is electrically connected to the plurality of piezoelectric elements and selects whether to detect a first residual vibration signal, which is generated in the first piezoelectric element, by using the residual vibration detection unit.

5. The liquid ejecting apparatus according to claim 4, wherein a resistor is disposed in parallel to the second switch.

6. The liquid ejecting apparatus according to claim 5, wherein the residual vibration detection unit detects the residual vibration signal on the basis of an amount of current flowing to the resistor.

7. The liquid ejecting apparatus according to claim 4, wherein the second switch is a MOS-FET.

8. The liquid ejecting apparatus according to claim 3, wherein the driving signal includes pulses in the order of the first ejection pulse, the second ejection pulse, and the inspection pulse.

* * * * *